US007416056B2

(12) United States Patent
Kim

(10) Patent No.: US 7,416,056 B2
(45) Date of Patent: Aug. 26, 2008

(54) EMERGENCY ELEVATOR SYSTEM

(76) Inventor: Kwon Woo Kim, 1500 Country Vistas La., Bonita, CA (US) 91902

( * ) Notice: Subject to any disclaimer, the term of this patent is extended or adjusted under 35 U.S.C. 154(b) by 463 days.

(21) Appl. No.: 11/204,561

(22) Filed: Aug. 15, 2005

(65) Prior Publication Data

US 2007/0034453 A1 Feb. 15, 2007

(51) Int. Cl.
*B66B 9/02* (2006.01)
*B66B 11/04* (2006.01)
*B66B 1/34* (2006.01)

(52) U.S. Cl. ..... 187/314; 187/250; 187/252; 187/404; 187/411

(58) Field of Classification Search ..... 187/250–252, 187/314, 404, 411
See application file for complete search history.

(56) References Cited

U.S. PATENT DOCUMENTS 473,036 A * 4/1892 Veenschoten ..... 187/313
1,763,198 A * 6/1930 Sprague ..... 187/249
5,152,374 A * 10/1992 Pokus ..... 187/249
5,375,682 A * 12/1994 Gopner ..... 187/411
5,573,084 A * 11/1996 Hakala ..... 187/252
5,584,364 A * 12/1996 Sakita ..... 187/249
6,854,564 B2 * 2/2005 Reuter et al. ..... 187/249
7,097,000 B2 * 8/2006 Teramoto et al. ..... 187/249
7,296,660 B1 * 11/2007 Bauge ..... 187/250
7,316,294 B2 * 1/2008 Mustalahti et al. ..... 187/249
2004/0007428 A1 * 1/2004 Teramoto et al. ..... 187/249
2005/0005809 A1 * 1/2005 Neale ..... 104/93
2007/0267254 A1 * 11/2007 Bauge ..... 187/316
2007/0278045 A1 * 12/2007 Bauge ..... 187/250

* cited by examiner

*Primary Examiner*—Lincoln Donovan
*Assistant Examiner*—Eduardo Colon
(74) *Attorney, Agent, or Firm*—Lee, Hong, Degerman, Kang & Schmadeka

(57) ABSTRACT

The present invention relates to an elevator system for use during an emergency. The elevator system comprises two elevator shafts constructed adjacent to each other. Each elevator shaft houses an elevator car. The elevator system operates without the use of a building's power source by incorporating a primary pulley system to move the elevator cars. Generally, the elevator cars work in tandem such that as one elevator car goes up its respective elevator shaft, the other elevator car will go down its respective elevator shaft. Moreover, a secondary pulley system and a gear system are employed to also facilitate movement of the elevator cars without using the building's power supply.

23 Claims, 6 Drawing Sheets

EMERGENCY ELEVATOR SYSTEM

FIELD OF THE INVENTION

The present invention relates to passenger elevator systems, and more particularly, to an elevator system for use during an emergency.

BACKGROUND OF THE INVENTION

Generally, elevators provide a method of transportation for moving persons or objects between floors of a building. These elevators include cars which travel within an elevator shaft. The cars are connected to a counterweight by hoist cables, all of which are oriented vertically within the shaft. Movement to a desired floor is achieved by electrically powered motors. These motors rely upon the building's power source and are controlled by electrical systems within the building.

During an emergency situation, such as an earthquake, fire or terrorist attack, the power within the building is often disrupted. Therefore, the conventional elevator system becomes unreliable. As a result, travel between floors during the emergency is reduced to the use of stairs, ladders or articulated arms. If the floor involved is relatively high (e.g. 50-100 floors), or if there are floors above a fire, ladders and articulated arms may not be able to reach the desired floor from the exterior of the building. Accordingly, the stairs may be used for persons to evacuate the building. However, considering that the evacuating persons will start from a relatively high floor, it will be hard-pressed and time consuming for the persons to walk down the stairs to safety.

Moreover, in the absence of conventional elevator service, emergency workers such as firefighters must hand carry any firefighting equipment to the affected area. This drastically reduces the amount of equipment than can be carried and the speed with which it can be deployed.

Therefore, there is a need for an elevator system which provides a reliable independent means to transport persons and objects between floors of a building during an emergency.

SUMMARY OF THE INVENTION

The present invention is directed to an elevator system for use during an emergency.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention is embodied in an elevator system for use during an emergency, the system comprising a first elevator shaft for housing a first elevator car, a second elevator shaft for housing a second elevator car, a primary pulley system operatively connecting the first elevator car to the second elevator car and facilitating one elevator car to descend its respective elevator shaft while the other elevator car ascends its respective elevator shaft, a secondary pulley system operatively connecting the first elevator car to the second elevator car and facilitating one elevator car to descend its respective elevator shaft while the other elevator car ascends its respective elevator shaft, a first gear system formed on an outer wall of the first elevator car and capable of engaging a rack formed on an inner portion of the first elevator shaft to facilitate movement of the first elevator car along the first elevator shaft when the first gear system is controlled from the inside of the first elevator car, and a second gear system formed on an outer wall of the second elevator car and capable of engaging a rack formed on an inner portion of the second elevator shaft to facilitate movement of the second elevator car along the second elevator shaft when the second gear system is controlled from the inside of the second elevator car.

The primary pulley system comprises a first pulley shaft formed on an upper portion of the first elevator shaft, a first pulley operatively engaged around the first pulley shaft, a second pulley shaft formed on an upper portion of the second elevator shaft, a second pulley operatively engaged around the second pulley shaft, and a cable engaging the first pulley and the second pulley, wherein a first end of the cable is connected to the first elevator car and a second end of the cable is connected to the second elevator car. Preferably, movement of one elevator along its respective elevator shaft using the primary pulley system is facilitated by the weight of persons loaded in the elevator car.

The secondary pulley system comprises an inner pulley formed between the first elevator shaft and the second elevator shaft, an outer pulley operatively connected to the inner pulley by a lower shaft, and a cable engaging the inner pulley, wherein a first end of the cable is connected to the first elevator car and a second end of the cable is connected to the second elevator car. Preferably, movement of the elevator cars along their respective elevator shafts using the secondary pulley system is facilitated by rotating the outer pulley to rotate the inner pulley to move the cable which moves the elevator cars. Preferably, the outer pulley is rotated manually or by an motor.

The first gear system and the second gear system comprise a big gear for engaging the rack formed on the inner portion of the elevator shaft, a small gear operatively engaged to the big gear, a gear plate for mounting the big gear and the small gear, and a gear plate mounting for mounting the gear plate onto the elevator car and allowing horizontal movement of the gear plate. Preferably, the elevator system further comprises a gear plate spring connecting the gear plate to the gear plate mounting and facilitating a retracted position of the gear plate, and a gear plate stopper for securing an engaged position of the gear plate.

In one aspect of the invention, the first gear system and second gear system are controlled by a control system formed on the inside of the elevator car. The control system comprises a big gear handle operatively connected to the big gear, a small gear handle operatively connected to the small gear, and a pedal operatively connected to the gear plate stopper.

Preferably, movement of one elevator car along its respective elevator shaft using its respective gear system is facilitated by horizontally moving the gear plate to an engaged position on the outside of the elevator car by horizontally moving the big gear handle and the small gear handle from the inside of the elevator, securing the engaged position of the gear plate by stepping on the pedal to activate the gear plate stopper to prevent the gear plate from moving to a retracted position, and turning the big gear handle or the small gear handle from the inside of the elevator car causing the gear teeth of the big gear to move along the rack, which causes the elevator car to move along the elevator shaft.

In another aspect of the invention, the first elevator car and the second elevator car comprise a rotatable hook formed on the outside of the first elevator car and the second elevator car, respectively, wherein the rotatable hook engages a hook hole formed on the inside of the first elevator shaft and the second elevator shaft, respectively, for securing non-movement of the elevator cars.

In a further aspect of the invention, each elevator shaft comprises a liquid reservoir for softening an impact of an elevator car descending to the bottom of a respective elevator shaft. Each elevator shaft comprises a liquid connecting hole for connected the respective liquid reservoirs.

Preferably, the outer pulley is detachably coupled to the lower shaft by a pulley pin.

In another aspect of the invention, the first elevator car and the second elevator car comprise a first wall, a second wall, a third wall and a fourth wall, wherein the first wall comprises an entrance door and a rotatable hook for locking the elevator car in a set position, the third wall comprises the gear system for facilitating movement of the elevator car, the fourth wall comprises an exit door, and all four walls comprise rollers for helping move the elevator car along the elevator shaft and an edge formed at a lower portion of the walls for slowing the descent of the elevator cars submerged in a respective liquid reservoir.

Preferably, the first elevator car and the second elevator car comprise a communication system for allowing persons in the elevator car to transmit and receive information, wherein the communication system is powered by a rechargeable battery. The rechargeable battery is charged by a generator mounted on the outside of the elevator car, wherein the generator generates electricity by rubbing and turning on the elevator shaft as the elevator car moves and manually turning a generator handle formed on the inside of the elevator car.

Preferably, the first elevator shaft and the second elevator shaft comprise an automatic locking system formed on an inner portion of the first elevator shaft and the second elevator shaft, respectively, wherein a rotatable hook formed on the outside of the first elevator car and the second elevator car, respectively, is capable of engaging the respective automatic locking systems for automatically securing non-movement of the first elevator car and the second elevator car.

Preferably, the automatic locking system comprises a hook hole for receiving the rotatable hook, a gear operatively fixed to the hook hole via a hook hole shaft, and a rack formed on an inner portion of the elevator shaft and operatively engaged with the gear, wherein when the gear rotates, the gear moves along a length of the rack causing the hook hole and the rotatable hook inserted in the hook hole to rotate in the direction of the gear rotation.

Preferably, the automatic locking system further comprises an outer handle formed on the outside of the elevator shaft and operatively connected to the gear and the hook hole, wherein the outer handle may be manually rotated to rotate the hook hole and the rotatable hook inserted in the hook hole.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. Features, elements, and aspects of the invention that are referenced by the same numerals in different figures represent the same, equivalent, or similar features, elements, or aspects in accordance with one or more embodiments.

DETAILED DESCRIPTION OF THE PREFERRED EMBODIMENTS

The present invention relates to an elevator system for use during an emergency. As shown in the figures, the elevator system allows persons and objects to be moved between floors of a building independent of the building's power source.

Figure 1:
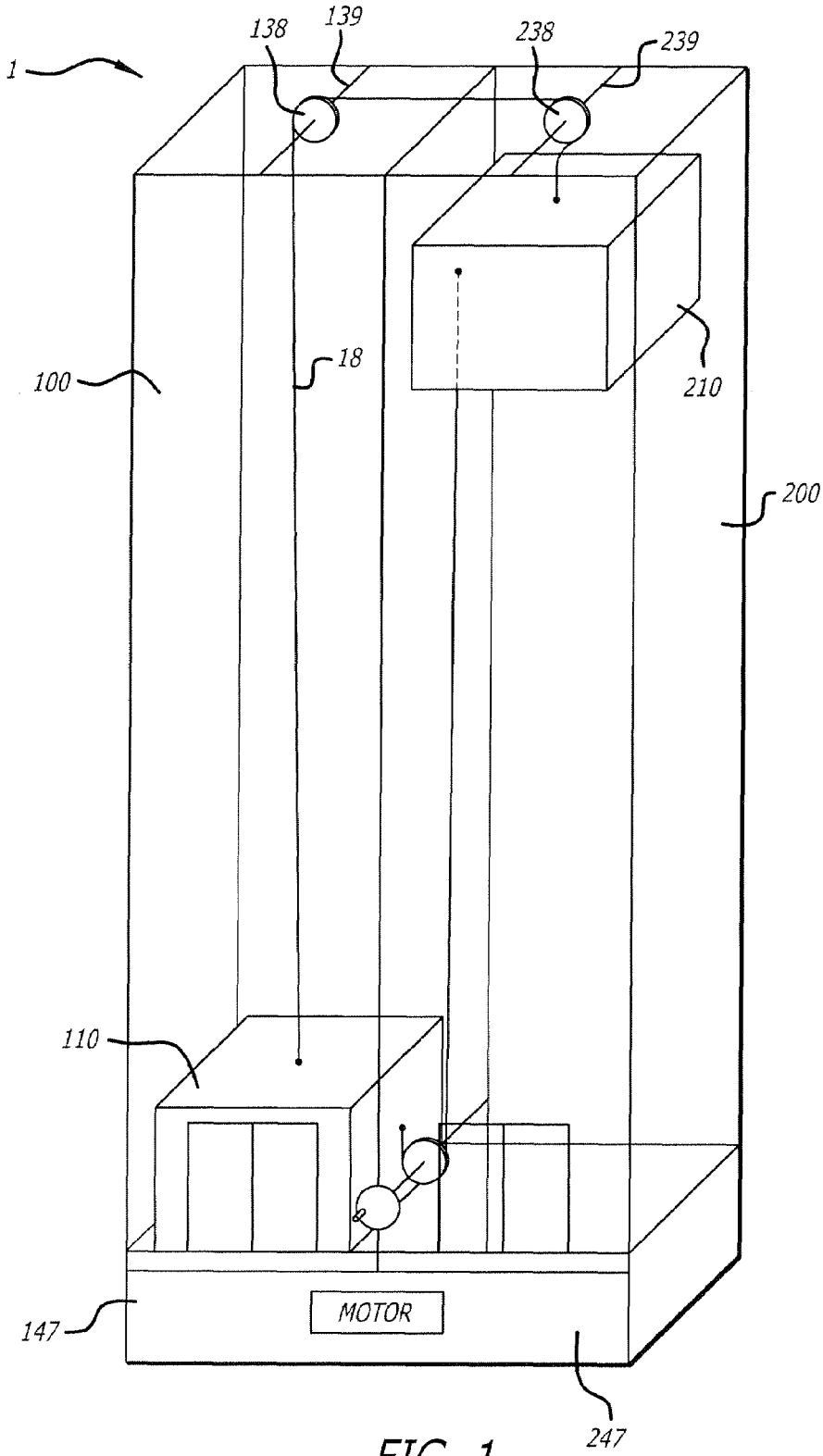
FIG. 1 illustrates a front view of an elevator system in accordance with one embodiment of the present invention.

Referring to FIG. 1, in one embodiment of the present invention, an elevator system 1 comprises two elevator shafts 100 and 200 constructed adjacent to each other. Each elevator shaft 100 and 200 houses elevator cars 110 and 210, respectively. The elevator system 1 operates without the use of a building's power source by incorporating a primary pulley system to move the elevator cars 110 and 210. Generally, the elevator cars 110 and 210 work in tandem such that as one elevator car goes up its respective elevator shaft, the other elevator car will go down its respective elevator shaft.

Referring to FIG. 1, the primary pulley system of the present invention will be explained. A pulley shaft 139 is constructed at an upper portion of the elevator shaft 100. Operatively engaged around the pulley shaft 139 is a pulley 138. Similarly, a pulley shaft 239 is constructed at an upper portion of the elevator shaft 200, wherein a pulley 238 is operatively engaged around the pulley shaft 239. One end of a cable 18 is coupled to the top of the elevator car 110. The cable 18 engages the pulley 138, stretches across to the elevator shaft 200 and engages the pulley 238, wherein the other end of the cable 18 is coupled to the top of the elevator car 210. Preferably, the length of the cable 18 is such that when the elevator car 110 is at a bottom portion of the elevator shaft 100, the elevator car 210 is allowed to be at an upper portion of the elevator shaft 200, and vice versa.

Figure 2:
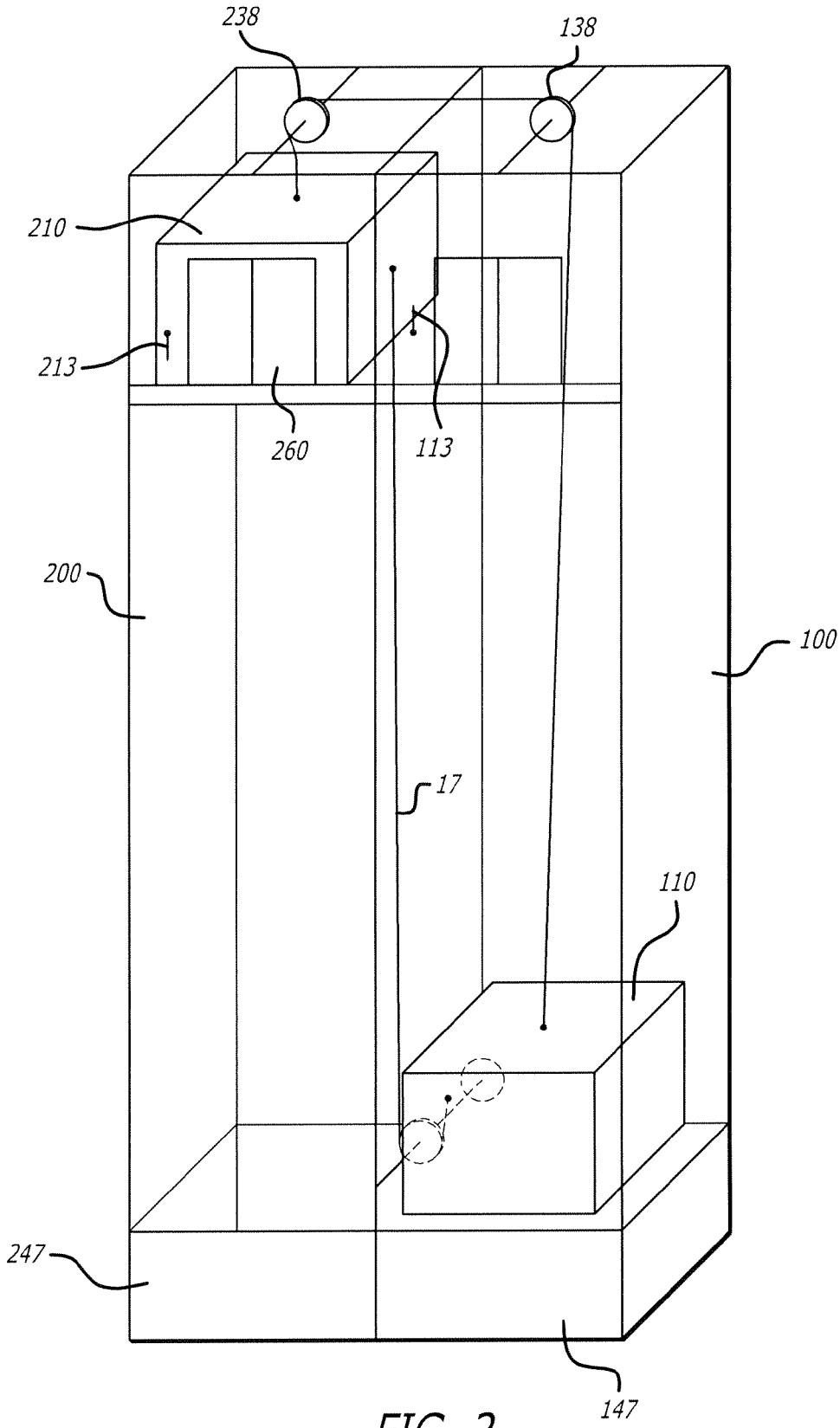
FIG. 2 illustrates a rear view of an elevator system in accordance with one embodiment of the present invention.
Figure 4:
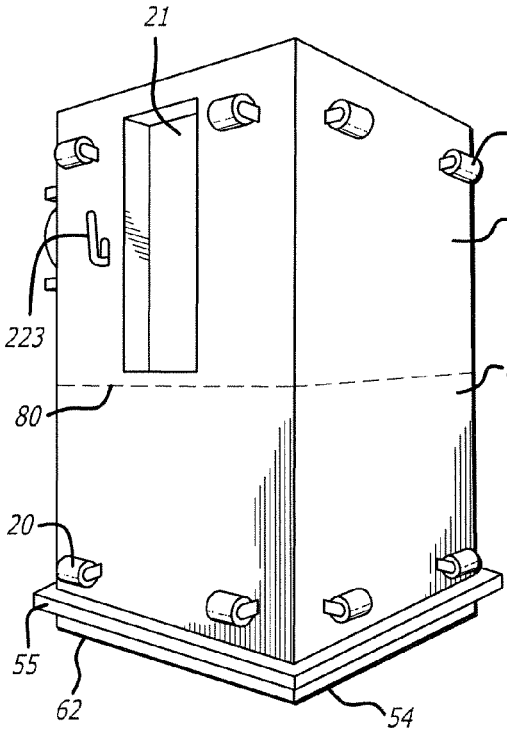
FIG. 4 illustrates a first and second wall of an elevator car in accordance with one embodiment of the present invention.
Figure 7:
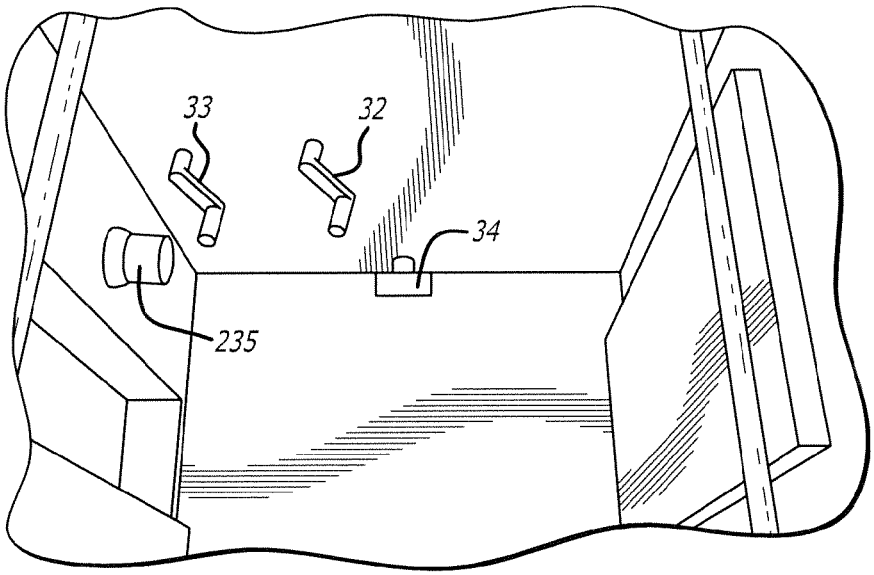
FIG. 7 illustrates a control system mounted inside an elevator car in accordance with one embodiment of the present invention.
Figure 8:
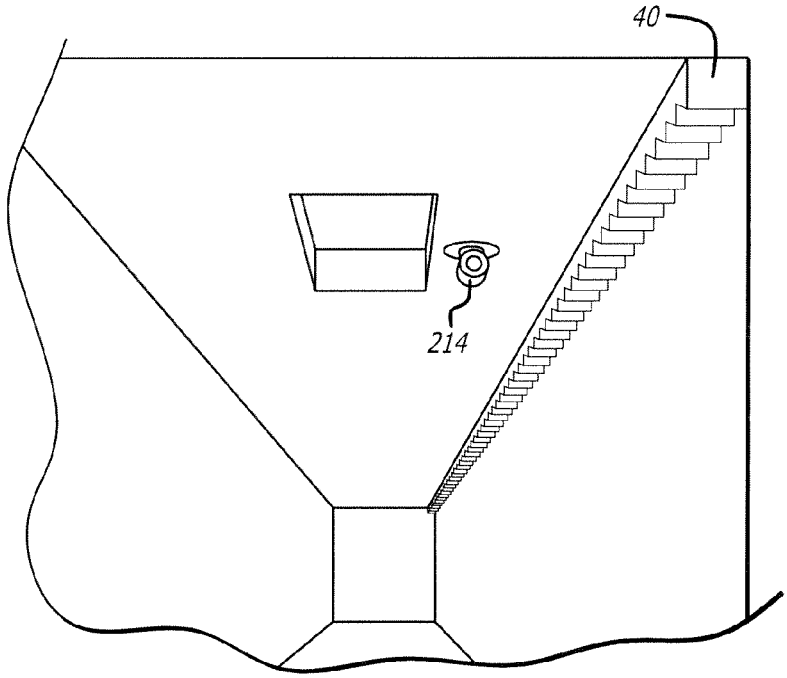
FIG. 8 illustrates a top view of an elevator shaft in accordance with one embodiment of the present invention.

As shown in FIG. 2, a lever 213 is in a downward position. This position signifies that the elevator car 210 is locked in place and will not move downward until the lever 213 is moved to an upward position such as the lever 113. In more detail, the lever 213 is operatively connected to a hook hole 214 (as shown in FIG. 8) formed on the inside of the elevator shaft 200. Thus, when the lever 213 is rotated, the hook hole 214 also rotates. The hook hole 214 accepts a rotatable hook 223 (as shown in FIG. 4) formed on the outside of the elevator car 210. Previously, when the elevator car 210 is not yet at an upper portion of the elevator shaft 200, the rotatable hook 223 is in an upward position. As the elevator car 210 ascends to the upper portion of the elevator shaft 200, the rotatable hook 223 engages the hook hole 214. Once engaged, the rotatable hook 223 may be turned to a downward position by rotating the lever 213 on the outside of the elevator shaft 200, or by rotating a hook handle 235 (as shown in FIG. 7) operatively connected to the rotatable hook 223 and found on the inside of the elevator car 210. Once the rotatable hook 223 is engaged to the hook hole 214 and moved to the downward position, the elevator car 210 is locked in place and will not move down the elevator shaft 200 until the hook 223 is moved to the upward position.

In accordance with one embodiment of the present invention, when persons wish to use the elevator system, the persons enter into the elevator car 210 through doors 260 at the upper portion of the elevator shaft 200. Upon closing the doors 260, the persons inside the elevator car 210 may unlock the elevator car by rotating the hook handle 235 to move the rotatable hook 223 to the downward position. Alternatively, persons present outside the elevator shaft 200 may unlock the elevator car 210 by rotating the lever 213 to move the rotatable hook 223 to the downward position. Once the elevator car 210 is unlocked, the weight of the persons inside the car will cause the car 210 to descend down the elevator shaft 200.

By means of the aforementioned primary pulley system, as the elevator car 210 descends down the elevator shaft 200, one end of the cable 18 coupled to the top of the elevator car 210 will also descend down the shaft 200. Because the other end of the cable 18 is coupled to the top of the elevator car 110 via the pulleys 238 and 138, and by way of the cable 18 being an appropriate length, the elevator car 110 will ascend to the upper portion of the elevator shaft 100 as the elevator car 210 descends down the elevator shaft 200. Once the elevator car 110 reaches the upper portion of the elevator shaft 100, the car 110 may be locked in place by a rotatable hook and hook hole mechanism similar to that of the elevator car 210 and the elevator shaft 200. When locked in place, the elevator car 110 is ready to accommodate more persons wishing to use the elevator system.

In one aspect of the invention, it is contemplated that as either one of the elevator cars 210 or 110 descends down their respective shafts, an impact will occur upon the elevator car reaching the bottom of the elevator shaft. Accordingly, liquid reservoirs 147 and 247 are respectively provided at the bottom of the elevator shafts 100 and 200 to cushion the possibly severe impact.

Figure 3:
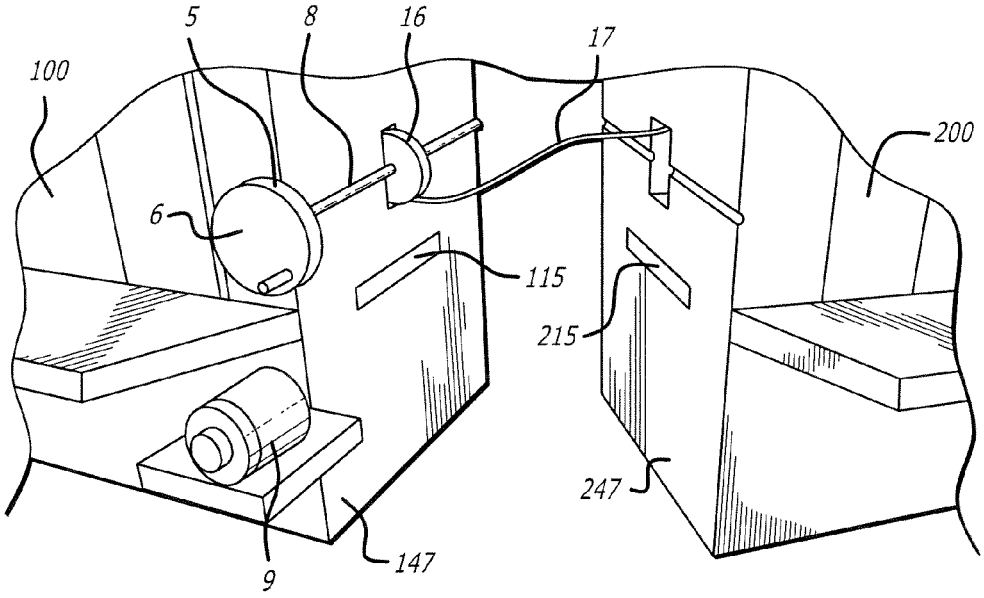
FIG. 3 illustrates an elevator system wherein two elevator shafts are separated to depict inner elements of a lower portion of the elevator system in accordance with one embodiment of the present invention.

Preferably, one elevator shaft's liquid reservoir is filled with liquid, such as water or oil, up to a level of a liquid connecting hole while the other elevator shaft has an elevator car on the ground. For example, as shown in FIGS. 1 and 3, while the elevator car 110 is on the ground floor of the elevator shaft 100, the liquid reservoir 247 of the elevator shaft 200 is filled with liquid up to a level of the liquid connecting hole 215 (as shown in FIG. 3). When the elevator 110 goes up, the elevator 210 will come down to make contact with the liquid in the liquid reservoir 247. As the elevator 210 settles at the bottom of the shaft 200, the weight of the elevator car 210 and any persons aboard the car, will cause the liquid to evacuate out of the liquid reservoir 247 through the liquid connecting hole 215 and reside in the liquid reservoir 147 of the elevator shaft 100 via a liquid connecting hole 115. As such, the liquid reservoir 147 will be sufficiently filled with liquid to cushion the impact of the elevator car 110 when it subsequently descends from the upper portion of the elevator shaft 100.

In accordance with another embodiment of the present invention, a secondary pulley system is provided at a lower portion of the elevator system to move the elevator cars 110 and 210. Referring to FIG. 3, the secondary pulley system comprises an inner pulley 16, an outer pulley 5, a lower shaft 8 and a secondary cable 17. The inner pulley 16 is formed in between the elevator shafts 100 and 200 and is operatively engaged around the lower shaft 8, which is also formed in between the elevator shafts 100 and 200. Operatively connected to the inner pulley 16 is the outer pulley 5 via the lower shaft 8. Specifically, the outer pulley 5 is coupled to the lower shaft 8 by a pulley pin 6. Therefore, while the pulley pin 6 is engaged, the outer pulley 5 may be rotated from the outside of the elevator shafts to rotate the lower shaft 8, which in turn rotates the inner pulley 16. However, the outer pulley 5 may be operatively disconnected from the lower shaft 8 and the inner pulley 16 by disengaging the pulley pin 6.

Referring to FIGS. 1 and 3, one end of the secondary cable 17 is coupled to the elevator car 110. The secondary cable 17 engages the inner pulley 16 and continues to the elevator shaft 200, wherein the other end of the secondary cable 17 is coupled to the elevator car 210. Preferably, the length of the secondary cable 17 is such that when the elevator car 110 is at the bottom portion of the elevator shaft 100, the elevator car 210 is allowed to be at an upper portion of the elevator shaft 200, and vice versa.

In case a descending elevator car is having trouble moving down the elevator shaft, such as when the persons in the elevator car are not heavy enough to move the elevator car, the secondary pulley system may be utilized to move the elevator. For example, if the elevator 210 is having trouble descending the elevator shaft 200, the outer pulley 5 may be operatively connected to the lower shaft 8 by engaging the pulley pin 6. Once engaged, the outer pulley 5 may be rotated to effectively rotate the inner pulley 16. Meanwhile, the secondary cable 17, which connects the two elevator cars together, is engaged to the inner pulley 16. Accordingly, as the inner pulley 16 is rotated, the secondary cable 17 moves, thus facilitating movement of the elevator cars. Specifically, rotating the outer pulley 5 to rotate the inner pulley 16 in the appropriate direction moves the elevator car 210 downward. Notably, movement of the elevator car 210 downward via the secondary pulley system will cause the elevator car 110 to move upward via the cable 18 and the primary pulley system.

In one aspect of the invention, a motor 9 may aid the secondary pulley system. Preferably, the motor 9 is operatively connected to the outer pulley 5 by a drive belt. When the motor 9 is turned on, the drive belt will move to cause rotation of the outer pulley 5, which then ultimately causes the elevator cars to move. Accordingly, because manual power to rotate the outer pulley 5 is limited, the motor 9 is preferable because it provides greater power to operate the secondary pulley system. Use of the motor 9 is further preferable when objects or persons, such as a rescue team, are to be transported up the elevator shaft.

Figure 5:
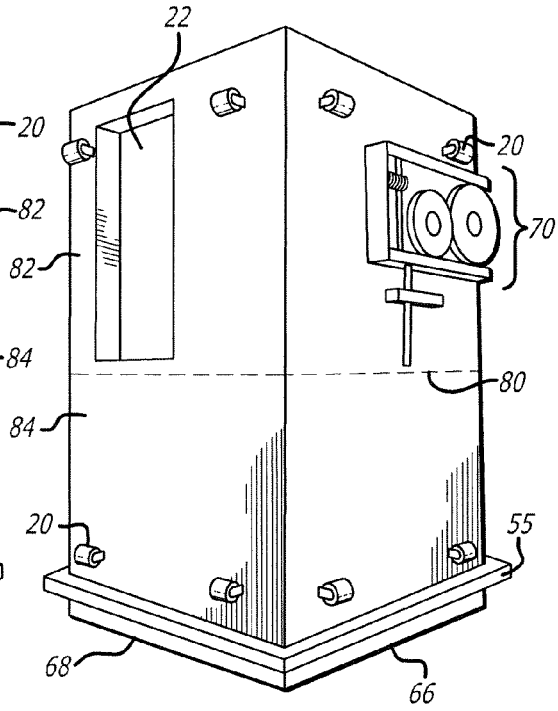
FIG. 5 illustrates a third and fourth wall of an elevator car in accordance with one embodiment of the present invention.

Referring to FIGS. 4 and 5, an elevator car of the present invention will be explained. The elevator car generally has a box-like shape and comprises a first wall 62, a second wall 64, a third wall 66 and a fourth wall 68. Rollers 20 are formed on all walls to aid the elevator car in going up and down the elevator shaft smoothly. An edge 55 is formed at a lower portion of all walls. The edge 55 helps slow the descent of the elevator car when it is submerged in either liquid reservoir 247 or 147 when the elevator car is on the ground floor. The edge 55 also facilitates the evacuation of liquid from one elevator shaft to another as the elevator car sinks in the liquid by providing more surface on the elevator car to help the liquid expand out of the elevator shaft.

A line 80 depicts how the elevator car is separated into a usable compartment 82 and an empty space 84. An elevator car floor (not shown) is formed on the inside of the elevator car between the usable compartment 82 and the empty space 84. Above the line 80, persons may load into the usable compartment 82 and stand on the elevator car floor to ride in the elevator car. Below the line 80 is the empty space 84, which is not accessible to persons. The empty space 84 is an air tight pocket and functions to put space between the persons riding in the elevator car and the liquid reservoir when the elevator car is at the bottom of the elevator shaft. Thus, the empty space 84 slows and softens the impact of the elevator car as it contacts the liquid reservoir during the elevator car's descent in the elevator shaft. Preferably, the liquid level of the liquid reservoir does not go above the height of the line 80.

The first wall 62 comprises an entrance door 21, which is the door used by persons wishing to enter the elevator car when the elevator car is located at the upper portion of the elevator shaft. The first wall 62 also includes the hook 223. As previously described above, the rotatable hook 223 is used for locking the elevator car in a set position. The third wall 66 comprises a gear system 70. As will be described below, the gear system 70 is provided to move the elevator car through the elevator shaft. The fourth wall 68 comprises an exit door 22, which is the door used to exit the elevator car when the elevator car has reached the bottom of the elevator shaft.

Figure 6:
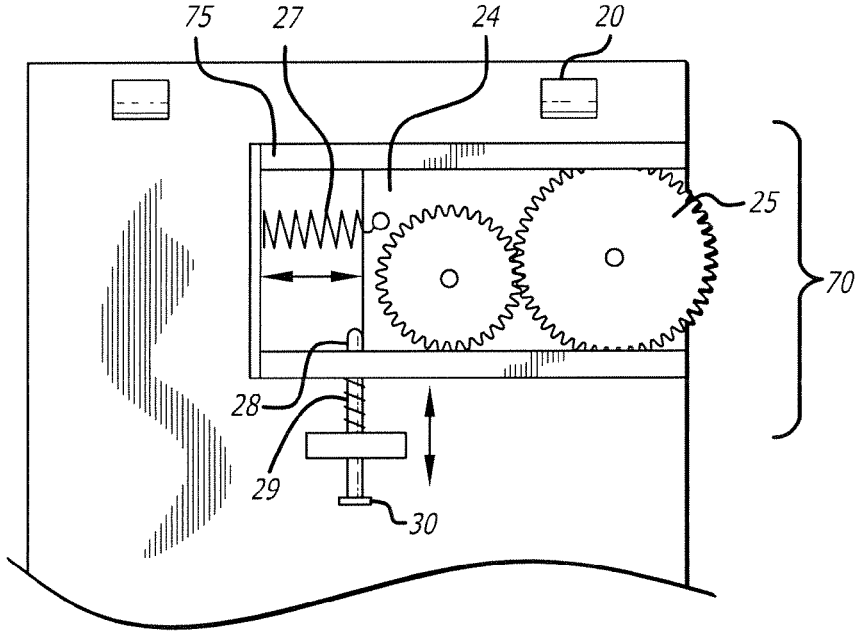
FIG. 6 illustrates a gear system in accordance with one embodiment of the present invention.

In accordance with another embodiment of the present invention, a gear system 70 is provided on a wall of the elevator car to move the elevator car through the elevator shaft. Referring to FIG. 6, the gear system 70 comprises a big gear 25, a small gear 26, a gear plate 24, a gear plate spring 27, a gear plate stopper 28, a gear stopper spring 29 and a pedal hand 30. The big gear 25 and the small gear 26 are operatively engaged to each other and are mounted onto the gear plate 24. The gear plate 24 is horizontally movable along a gear plate mounting 75. When the gear system 70 is not in use, the gear plate 24 is in a retracted position in the gear plate mounting 75. The retracted position is secured by the gear plate spring 27, wherein one end of the spring is coupled to the gear plate 24 while the other end of the spring is coupled to a rear end of the gear plate mounting 75.

When the gear system 70 is in use, the gear plate 24 may be horizontally moved to an engaged position. The engaged position is secured by the gear plate stopper 28, wherein the gear plate stopper 28 is activated using the gear stopper spring 29 and the pedal hand 30 to stop rearward movement of the gear plate 24. The gear system 70 is controlled by a control system formed directly opposite the gear system 70 on the inside of the elevator car. Referring to FIG. 7, the control system comprises a big gear handle 33, a small gear handle 32 and a pedal 34. Through the elevator car wall, the big gear handle 33 is operatively connected to the big gear 25, the small gear handle 32 is operatively connected to the small gear 26 and the pedal 34 is operatively connected to the pedal hand 30.

In case a descending elevator car is having trouble moving down the elevator shaft, such as when persons in the elevator car are not heavy enough to move the elevator car, the gear system 70 may be utilized to move the elevator in the following manner. Initially, the gear plate 24 of the gear system 70 is in the retracted position. To move the gear plate 24 into the engaged position, a person on the inside of the elevator car must use the big gear handle 33 and small gear handle 32 to horizontally move the gear plate 24. As such, the holes through which the gear handles are connected to the gears are designed to allow horizontal movement of the gear handles thus allowing horizontal movement of the gear plate 24. Once the gear plate 24 is in the engaged position, the person may secure the position by stepping on the pedal 34. When the pedal 34 is stepped on, the pedal hand 30 located on the outside of the elevator car is activated and causes the gear plate stopper 28 to move up and block the gear plate 24 from moving rearward or back to the retracted state.

When the gear plate 24 is in the engaged state, the big gear 25 engages a rack 40, as shown in FIG. 8, vertically formed along an inner portion of the elevator shaft. Accordingly, by turning either the big gear handle 33 or the small gear handle 32 from the inside of the elevator car, the gear teeth of the big gear 25 will move along the rack 40 causing the elevator car to move. Preferably, when the descending elevator car is having trouble moving down the elevator shaft, the gear system 70 may be utilized by persons riding inside the elevator car to help move the elevator car down. Alternatively, the gear system 70 may also be used to help move the elevator in an upward direction.

Figure 9:
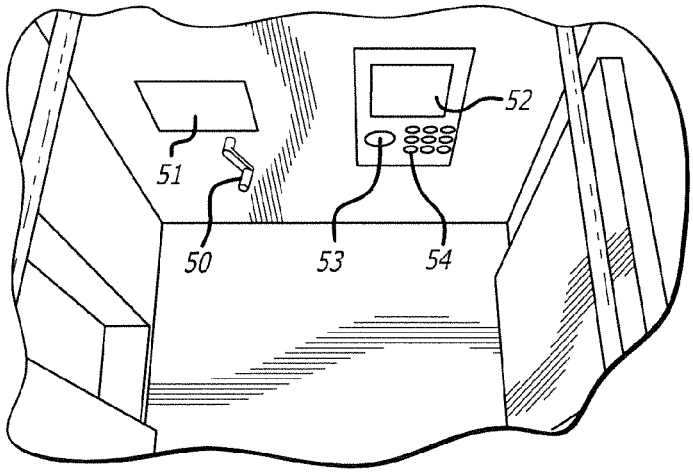
FIG. 9 illustrates a communication system and a rechargeable battery mounted inside an elevator car in accordance with one embodiment of the present invention.

In one aspect of the invention, the elevator car may also provide a communication system for allowing persons riding the elevator to transmit or receive information. As shown in FIG. 9, the communication system comprises a television monitor 52, a camera or microphone 53 and a speaker 54 mounted onto a wall of the elevator car. Because the elevator car operates independent of a building's power supply, the communication system uses a rechargeable battery 51 as its power supply.

Figure 10:
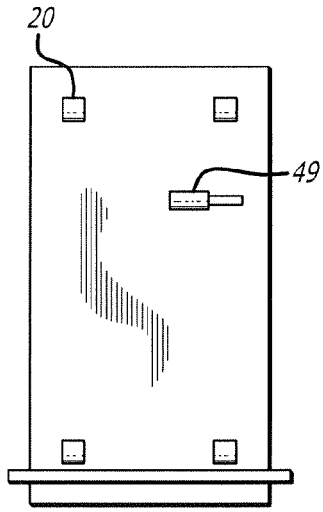
FIG. 10 illustrates a generator mounted outside an elevator car in accordance with one embodiment of the present invention.

Preferably, a generator 49 is mounted to an outside wall of the elevator car directly opposite the rechargeable battery 51, as shown in FIG. 10. The generator 49 is operatively connected to the rechargeable battery 51 and generates electricity by rubbing and turning on the elevator shaft as the elevator car goes up and down. The generator 49 then stores the generated electricity in the rechargeable battery 51, which then powers the communication system. Notably, a generator handle 50 is also provided on the inside of the elevator car. The generator handle 50 allows a person to manually turn the generator 49 to create electricity when there is not enough stored energy in the battery 51 or when the generator 49 cannot produce electricity because there is no movement of the elevator car.

Figure 11:
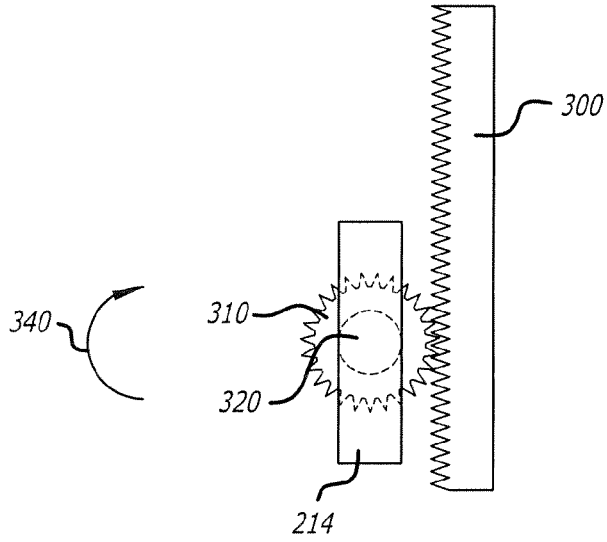
FIG. 11 illustrates a front view of an automatic locking system in accordance with one embodiment of the present invention.
Figure 12:
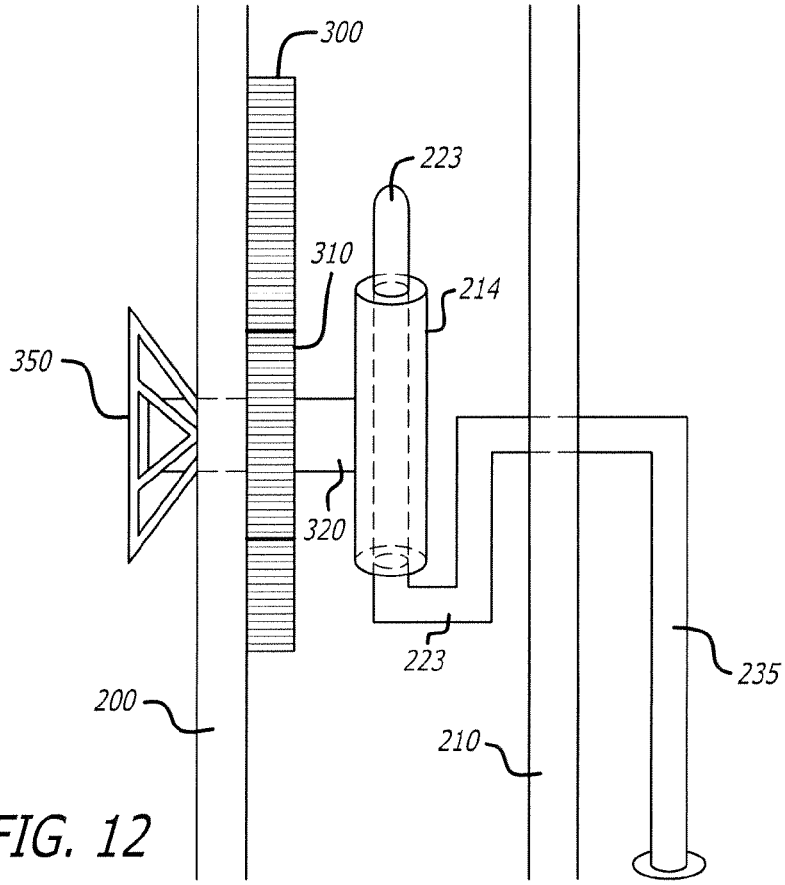
FIG. 12 illustrates a side view of an automatic locking system engaged with rotatable hook in accordance with one embodiment of the present invention.

Referring to FIGS. 11 and 12, an automatic locking system in accordance with one embodiment of the present invention is described. As shown, the automatic locking system comprises the hook hole 214 formed on the inside of the elevator shaft 200. The hook hole 214 is fixed to a gear 310 by a hook hole shaft 320. When the gear 310 rotates, the hook hole 214 rotates along with the gear 310 via the hook hole shaft 320. Furthermore, the gear 310 is operatively engaged to a rack 300 formed on an inside wall of the elevator shaft 200 adjacent to where the hook hole 214 is formed. When the gear 310 rotates, the gear 310 moves along a length of the rack 300.

When the elevator car 210 ascends to the upper portion of the elevator shaft 200, the rotatable hook 223, formed on the outside of the elevator car 210 and positioned in an upward direction, inserts into the hook hole 214. Due to the momentum of the ascending elevator car 210, the rotatable hook 223 causes an upward movement of the hook hole 214 as the rotatable hook 223 inserts into the hook hole 214. Accordingly, upward movement of the hook hole 214 causes the gear 310, via the hook hole shaft 320, to rotate in the direction of arrow 340 of FIG. 11.

When the gear 310 rotates in the direction of arrow 340, the hook hole 214 via the hook hole shaft 320 also rotates in the same direction. Accordingly, the rotatable hook 223 inserted in the hook hole 214 is caused to rotate. The rotatable hook 223 will continue to rotate until the rotatable hook 223 is positioned in a downward direction. Once the rotatable hook 223 is in the downward position, the elevator car 210 is locked in place and will not move down the elevator shaft 200 until the hook 223 is moved back to the upward position. Preferably, the hook 223 may be moved back to the upward position by manually rotating the hook handle 235.

Furthermore, an outer handle 350 is formed on the outside of the elevator shaft 200 and is operatively connected to the gear 310 and the hook hole 214 through a wall of the elevator shaft 200. Preferably, the outer handle 350 moves along with the gear 310 and the hook hole 214. Therefore, in case of an unexpected situation, such as when the gear 310 does not rotate correctly, the outer handle 350 may be manually rotated from the outside of the elevator shaft 200 to rotate the hook hole 214, thus allowing the rotatable hook 223 to be rotated in a desired direction. Although the automatic locking system has been described in relation to the elevator car 210 and the elevator shaft 200, it is contemplated that the automatic locking system may also be used with the elevator car 110 and the elevator shaft 100.

An advantage of the automatic locking system is that the rotatable hook does not need to be manually rotated to the downward position once the elevator car has ascended to the top of the elevator shaft. The elevator car will lock itself in place automatically. Thus, the automatic locking system prevents accidents or mistakes from happening, such as when a person forgets to manually rotate the rotatable hook 223 inserted in the hook hole 214, therefore failing to lock the elevator car in place.

Therefore, the present invention is a reliable, simple and quick means to transport persons and objects between floors of a building during an emergency. Moreover, the present invention allows persons and objects to be moved between floors of a building independent of the building's power source.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structure described herein as performing the recited function and not only structural equivalents but also equivalent structures.

What is claimed is:

1. An elevator system for use during an emergency, the system comprising:

a first elevator shaft for housing a first elevator car;

a second elevator shaft for housing a second elevator car;

a primary pulley system operatively connecting the first elevator car to the second elevator car and facilitating one elevator car to descend its respective elevator shaft while the other elevator car ascends its respective elevator shaft;

a secondary pulley system operatively connecting the first elevator car to the second elevator car and facilitating one elevator car to descend its respective elevator shaft while the other elevator car ascends its respective elevator shaft;

a first gear system formed on an outer wall of the first elevator car and capable of engaging a rack formed on an inner portion of the first elevator shaft to facilitate movement of the first elevator car along the first elevator shaft when the first gear system is controlled from the inside of the first elevator car; and a second gear system formed on an outer wall of the second elevator car and capable of engaging a rack formed on an inner portion of the second elevator shaft to facilitate movement of the second elevator car along the second elevator shaft when the second gear system is controlled from the inside of the second elevator car.

2. The elevator system of claim 1, wherein the primary pulley system comprises:

a first pulley shaft formed on an upper portion of the first elevator shaft;

a first pulley operatively engaged around the first pulley shaft;

a second pulley shaft formed on an upper portion of the second elevator shaft;

a second pulley operatively engaged around the second pulley shaft; and a cable engaging the first pulley and the second pulley, wherein a first end of the cable is connected to the first elevator car and a second end of the cable is connected to the second elevator car.

3. The elevator system of claim 1, wherein movement of one elevator along its respective elevator shaft using the primary pulley system is facilitated by the weight of persons loaded in the elevator car.

4. The elevator system of claim 1, wherein the secondary pulley system comprises:

an inner pulley formed between the first elevator shaft and the second elevator shaft;

an outer pulley operatively connected to the inner pulley by a lower shaft; and a cable engaging the inner pulley, wherein a first end of the cable is connected to the first elevator car and a second end of the cable is connected to the second elevator car.

5. The elevator system of claim 4, wherein movement of the elevator cars along their respective elevator shafts using the secondary pulley system is facilitated by rotating the outer pulley to rotate the inner pulley to move the cable which moves the elevator cars.

6. The elevator system of claim 4, wherein the outer pulley is detachably coupled to the lower shaft by a pulley pin.

7. The elevator system of claim 5, wherein the outer pulley is rotated manually or by a motor.

8. The elevator system of claim 1, wherein the first gear system and the second gear system comprise:

a big gear for engaging the rack formed on the inner portion of the elevator shaft;

a small gear operatively engaged to the big gear;

a gear plate for mounting the big gear and the small gear; and a gear plate mounting for mounting the gear plate onto the elevator car and allowing horizontal movement of the gear plate.

9. The elevator system of claim 8, further comprising:

a gear plate spring connecting the gear plate to the gear plate mounting and facilitating a retracted position of the gear plate; and a gear plate stopper for securing an engaged position of the gear plate.

10. The elevator system of claim 8, wherein the first gear system and second gear system are controlled by a control system formed on the inside of the elevator car.

11. The elevator system of claim 10, wherein the control system comprises:

a big gear handle operatively connected to the big gear;

a small gear handle operatively connected to the small gear; and a pedal operatively connected to the gear plate stopper.

12. The elevator system of claim 11, wherein movement of one elevator car along its respective elevator shaft using its respective gear system is facilitated by:

horizontally moving the gear plate to an engaged position on the outside of the elevator car by horizontally moving the big gear handle and the small gear handle from the inside of the elevator;

securing the engaged position of the gear plate by stepping on the pedal to activate the gear plate stopper to prevent the gear plate from moving to a retracted position; and turning the big gear handle or the small gear handle from the inside of the elevator car causing the gear teeth of the big gear to move along the rack, which causes the elevator car to move along the elevator shaft.

13. The elevator system of claim 1, wherein the first elevator car and the second elevator car comprise a rotatable hook formed on the outside of the first elevator car and the second elevator car, respectively, wherein the rotatable hook engages a hook hole formed on the inside of the first elevator shaft and the second elevator shaft, respectively, for securing non-movement of the elevator cars.

14. The elevator system of claim 1, wherein each elevator shaft comprises a liquid reservoir for softening an impact of an elevator car descending to the bottom of a respective elevator shaft.

15. The elevator system of claim 14, wherein each elevator shaft comprises a liquid connecting hole for connected the respective liquid reservoirs.

16. The elevator system of claim 1, wherein the first elevator car and the second elevator car comprise a first wall, a second wall, a third wall and a fourth wall, wherein:

the first wall comprises an entrance door and a rotatable hook for locking the elevator car in a set position;

the third wall comprises the gear system for facilitating movement of the elevator car;

the fourth wall comprises an exit door; and all four walls comprise rollers for helping move the elevator car along the elevator shaft and an edge formed at a lower portion of the walls for slowing the descent of the elevator cars submerged in a respective liquid reservoir.

17. The elevator system of claim 1, wherein the first elevator car and the second elevator car comprise a communication system for allowing persons in the elevator car to transmit and receive information.

18. The elevator system of claim 17, wherein the communication system is powered by a rechargeable battery.

19. The elevator system of claim 18, wherein the rechargeable battery is charged by a generator mounted on the outside of the elevator car.

20. The elevator system of claim 19, wherein the generator generates electricity by:

rubbing and turning on the elevator shaft as the elevator car moves; and manually turning a generator handle formed on the inside of the elevator car.

21. The elevator system of claim 1, wherein the first elevator shaft and the second elevator shaft comprise an automatic locking system formed on an inner portion of the first elevator shaft and the second elevator shaft, respectively, wherein a rotatable hook formed on the outside of the first elevator car and the second elevator car, respectively, is capable of engaging the respective automatic locking systems for automatically securing non-movement of the first elevator car and the second elevator car.

22. The elevator system of claim 21, wherein the automatic locking system comprises:

a hook hole for receiving the rotatable hook;

a gear operatively fixed to the hook hole via a hook hole shaft; and a rack formed on an inner portion of the elevator shaft and operatively engaged with the gear;

wherein when the gear rotates, the gear moves along a length of the rack causing the hook hole and the rotatable hook inserted in the hook hole to rotate in the direction of the gear rotation.

23. The elevator system of claim 22, wherein the automatic locking system further comprises an outer handle formed on the outside of the elevator shaft and operatively connected to the gear and the hook hole, wherein the outer handle may be manually rotated to rotate the hook hole and the rotatable hook inserted in the hook hole.

* * * * *